US005955160A

United States Patent [19]

Tanaka et al.

[11] Patent Number: 5,955,160

[45] Date of Patent: Sep. 21, 1999

[54] SNAP ZIPPER AND A BAG WITH THE SAME

[75] Inventors: Kenichi Tanaka; Masao Takashige; Yoshikazu Shirai, all of Himeji, Japan

[73] Assignee: Idemitsu Petrochemical Co., Ltd., Tokyo, Japan

[21] Appl. No.: 08/876,045

[22] Filed: Jun. 13, 1997

[30] Foreign Application Priority Data

Jun. 17, 1996 [JP] Japan ..... 8-155311

[51] Int. Cl.[6] ..... B31B 1/90

[52] U.S. Cl. ..... 428/34.1; 428/35.7; 428/33; 206/810; 220/253; 220/213; 220/350; 383/97; 383/63; 383/109; 383/113

[58] Field of Search ..... 428/35.7, 33, 34.1, 428/664; 206/810; 220/213, 253, 350; 383/97, 63, 109, 113

[56] References Cited

U.S. PATENT DOCUMENTS 5,335,997 8/1994 Kanemitxu ..... 383/63
5,603,995 2/1997 Takubo et al. ..... 428/34.1
5,645,905 7/1997 Takubo et al. ..... 428/35.7
5,700,091 12/1997 Tanaka et al. ..... 383/63
5,733,636 3/1998 May ..... 428/200

FOREIGN PATENT DOCUMENTS 5-331324 12/1993 Japan .

*Primary Examiner*—Charles Nold
*Attorney, Agent, or Firm*—Flynn, Thiel, Boutell & Tanis, P.C.

[57] ABSTRACT

Each base for fusing a snap-zipper male member and a snap-zipper female member, which form a snap zipper, onto a bag body is formed from a mixture of polypropylene and an ethylene copolymer obtained by copolymerizing ethylene and an α-olefin having a carbon atom ratio of 3 to 20, in which the ethylene copolymer has a weight average molecular weight/number average molecular weight of less than 3, density in the range from 0.850 g/cm$^3$ to 0.935 g/cm$^3$, melt index in the range from 0.3 g/10 min. to 15 g/10 min., and range of number of branching dependent on molecular weight of 0–5 branches/1,000 carbon. A bag with the snap zipper is structured to fuse the snap zipper through the bases onto the bag body.

11 Claims, 1 Drawing Sheet

SNAP ZIPPER AND A BAG WITH THE SAME

BACKGROUND OF THE INVENTION

1. Field of the Invention

This invention relates to a snap zipper and a bag with the snap zipper, which is used as a bag for foods, medical supplies or the like.

2. Description of the Related Art

A bag (a bag with a snap zipper), which is sealable by a band-shaped snap zipper, composed of a snap-zipper male member and a snap-zipper female member and located at an opening area of the bag, is used in various fields, such as foods, medical supplies, miscellaneous goods and so on. Various methods for fabricating the bag with the snap zipper are proposed.

For instances, (1) a method in which a bag body film and a snap zipper are unitedly formed by an extrusion molding method; (2) a method in which a snap zipper is formed on a bag body film by an extrusion molding method; (3) a method in which a tape previously formed with a snap zipper is fused on a bag body film; and so on.

Lately, method (3) has been widely used in view of the production cost, stock material and so on.

Generally, the material of the snap zipper is a resin of a similar type to a sealant layer as a film layer to which the snap zipper of the bag body is fused thereon. For example, where the sealant layer is polypropylene, the snap zipper is formed from the same polypropylene.

The conventional snap zipper consisting of polypropylene has inferior properties for cold proofing because of a high-rigidity, so that it can be broken at a low temperature in winter when the engaging strength of a male member and a female member is enhanced.

Further, when the bag is made by fusing the snap zipper on a laminated film composed of a biaxial oriented polypropylene film and a non-oriented polypropylene film, the melting points of the snap zipper and the laminated film are similar, resulting in a disadvantage where a fused area between the snap zipper and the biaxial oriented polypropylene film forming the outer-most layer of the bag is easily heat-deteriorated. The heat deterioration especially occurs easily in the process in which an area of the snap zipper, located at the side-sealed portion of the bag body, is heatedly pressured (i.e., crushing of zipper) after the snap zipper is fused onto the laminated film. Therefore, a high degree of art for producing the bag is required in order to avoid the heat deterioration.

It is the object of the present invention to produce a snap zipper and a bag with a snap zipper, in which the cold proofing is improved, and the snap zipper is easily fused on a bag body without heat deterioration.

SUMMARY OF THE INVENTION

The present invention is a snap zipper having a snap-zipper male member and a snap-zipper female member, and is characterized by including a base for fusing formed in each of the snap-zipper male member and the snap-zipper female member; and a male engaging portion and a female engaging portion respectively formed in the snap-zipper male member and the snap-zipper female member to engage with each other, in which the base is formed from a mixture of polypropylene and an ethylene copolymer obtained by copolymerizing ethylene and an α-olefin having a carbon atom ratio of 3 to 20, and an ethylene copolymer having a weight average molecular weight/number average molecular weight of less than 3, a density in the range from 0.850 g/cm$^3$ to 0.935 g/cm$^3$, a melt index in the range from 0.3 g/10 min. to 15 g/10 min., and a range of the number of branching dependent on molecular weight of 0 branches-5 branches/1,000 carbon.

As to the ethylene copolymer used in the present invention, the weight average molecular weight/number average molecular weight is less than 3, and the range of the number of branching dependent on the molecular weight is 0–5 branches/1,000 carbon, so that a low-molecular weight component and a high-molecular weight component in relation to the main component are fewer, resulting in an approximately balanced molecular weight component. The base of the snap zipper according to the present invention is formed from the mixture of the ethylene copolymer and polypropylene, so that the snap zipper is allowed to be fused onto the bag body at a lower temperature than the snap zipper formed from polypropylene as a single substance. And further, the flexibility of the snap zipper at a low temperature is improved, thus enhancing the cold proofing.

The melt index (MI) of the aforementioned polypropylene can be, for example, from 1 g/10 min. to 20 g/10 min., more preferably, from 2 g/10 min. to 20 g/10 min. When the MI is less than 1 g/10 min., the production speed is slower and roughness easily occurs on the surface of the base. And where MI is more than 20 g/10 min., the configurations of the male and female members are hardly retained.

As to polypropylene, a homopolymer of polypropylene, a copolymer (block, random) with ethylene, a terpolymer with ethylene and 1-butene, a mixture thereof or the like can be used, more preferably, a copolymer with ethylene, a terpolymer with ethylene and 1-butene and so on, having a low melting point and low rigidity.

The ethylene copolymer is obtained by copolymerizing ethylene and an α-olefin having a carbon atom ratio of 3 to 20 by using a single sight catalyst, which is allowed to be produced by using copolymerizing methods, such as slurry copolymerization, vapor phase copolymerization, cyclic copolymerization, solution copolymerization, suspension copolymerization, and so on (see Japanese Patent Application Laid-open No. Hei5-331324).

As to the measurement of the aforementioned weight average molecular weight (Mw)/number average molecular weight (Mn), a measuring apparatus, which, for example, the differential viscometer MODEL110 (a trade name) made by Viscotek Co. Ltd. is connected to the GPC device M150C (a trade name) made by Waters Co. Ltd., can be used. As to the measuring conditions, for example, with the use of two columns of Shodex UT-806L (a trade name), a sampling amount can be defined as 2 mg/ml; a temperature can be defined as 135° C.; a flow rate can be defined as 1 ml/min.; and trichlorobenzene (TCB) can be used as the solvent at a flow rate of 200 μg. Thereby allowing the weight average molecular weight(Mw)/number average molecular weight (Mn) to be found from the obtained value of the molecular weight (Mw and Mn).

When the weight average molecular weight(Mw)/number average molecular weight (Mn) of the ethylene copolymer exceeds 3, the high-molecular weight component and the low-molecular weight component in relation to the main component are increased, so that effective low-temperature sealability is not obtained.

The aforementioned density is measured in accordance with JIS K-6760, which is measured by a gradient density tube method without anneal.

When the density of the ethylene copolymer is less than 0.850 g/cm$^3$, the rigidity of the snap zipper is increased and viscidness occurs on the snap zipper with the passage of time. But when the density exceeds 0.935 g/cm$^3$, the sealability at a low-temperature is not obtained. The preferred density is in a range from 0.850 g/cm$^3$ to 0.870 g/cm$^3$.

The melt index (MI) is measured in accordance with JIS K-7210.

When the MI of the ethylene copolymer is smaller than 0.3 g/10 min., the production speed is slower and the roughness easily occurs on the surface of the obtained snap zipper. But when the MI is larger than 15 g/10 min., the configurations of the male and female members are hardly retained.

The range of the number of branching dependent on the molecular weight is found by using, for example, the GPC device M150C (a trade name) made by Waters Co. Ltd., and FTIR (1760) (a trade name) made by Perkin Elmer Co., Ltd. which is for measuring the branching coefficient. As to the specific measuring conditions, for example, with the use of two columns of Shodex UT-806L (a trade name), a sampling amount can be defined as 5 mg/ml; a temperature can be defined as 135° C.; a flow rate can be defined as 1 ml/min.; and trichlorobenzene (TCB) can be used as solvent. The molecular-weight distribution found under the aforementioned measuring conditions is divided into 10, and the average number of branching of each fraction found by FTIR, namely, the difference between the maximum value and the minimum value of the number of branching every the molecular weight, is allowed to be defined as the range dependent on the molecular weight (incidentally, the fraction which the divided area is less than 4% is cut).

The range of the number of branching dependent on the molecular weight of the ethylene copolymer means that the difference between the maximum number of branching and the minimum number of branching is from zero to five to 1,000 carbon atoms of a copolymer in the fraction of the total molecular weight. In other words, it means that there is not a large difference in the number of branching of the copolymer in every fraction of the molecular weight (regardless of the fraction of the high-molecular weight or the fraction of the low-molecular weight). When the range dependent on the molecular weight exceeds five, the engagement performance becomes inferior in view of viscidity and the heat sealing performance becomes inferior in view of the increased fusion temperature.

It is advisable that the mixing proportion of the ethylene copolymer in the aforementioned mixture is defined as 1 wt.% to 50 wt.%, more preferably, from 5 wt.% to 30 wt.%.

When the mixing proportion of the ethylene copolymer exceeds 50 wt.%, the rigidity of the snap zipper may decrease and it is a concern that the sliding performance of the surface of the snap zipper becomes inferior. But in the mixing proportion of less than 1 wt.%, the effects of the present invention may be not obtained.

If necessary, additives, such as an antistat, anti-fogging additive, stabilization agent, slip agent, colorant and so on, can be added into the mixture of polypropylene and the ethylene copolymer.

When the base is, for example, a two-layer structure, each layer in the base can be formed from the aforementioned mixture, and only the layer directly fused onto the bag body can be formed from the aforementioned mixture. In other words, where the base has multiple layers, it is necessary that at least the layer directly fused onto the bag body is formed from the aforementioned mixture, and the other layers which are not directly fused onto the bag body can be formed from, for example, a low density polyethylene (LDPE), a linear low density polyethylene (L-LDPE), or the like.

Also, the present invention is a bag with a snap zipper comprising a snap zipper having a snap-zipper male member and a snap-zipper female member is fused on a bag body, and is characterized by including a base for fusing formed in each of the snap-zipper male member and the snap-zipper female member; and a male engaging portion and a female engaging portion respectively formed in the snap-zipper male member and the snap-zipper female member to engage with each other, in which the base is formed from a mixture of polypropylene and an ethylene copolymer obtained by copolymerizing ethylene and an α-olefin having a carbon atom ratio of 3 to 20; the ethylene copolymer has a weight average molecular weight/number average molecular weight of less than 3, a density in the range from 0.850 g/cm$^3$ to 0.935 g/cm$^3$, a melt index in the range from 0.3 g/10 min. to 15 g/10 min., and a range of the number of branching dependent on the molecular weight of 0 branches-5 branches/1,000 carbon; and the snap-zipper male member and the snap-zipper female member are fused through the bases to the bag body.

The resin forming the bag body is not limited insofar as the resin is allowed to be fused onto the aforementioned snap zipper, but it is advisable that the bag body has a sealant layer formed from polypropylene; and the snap zipper is fused onto the sealant layer.

The bag body is allowed to be a laminated film composed of, for example, a biaxially oriented polypropylene film and a non-oriented polypropylene film, so that the snap portion is allowed to be fused onto the bag body at a low temperature, thus allowing the biaxially oriented polypropylene film as the sealant layer to be easily fused without heat deterioration.

DETAILED DESCRIPTION OF THE PREFERRED EMBODIMENT(S)

Figure 1:
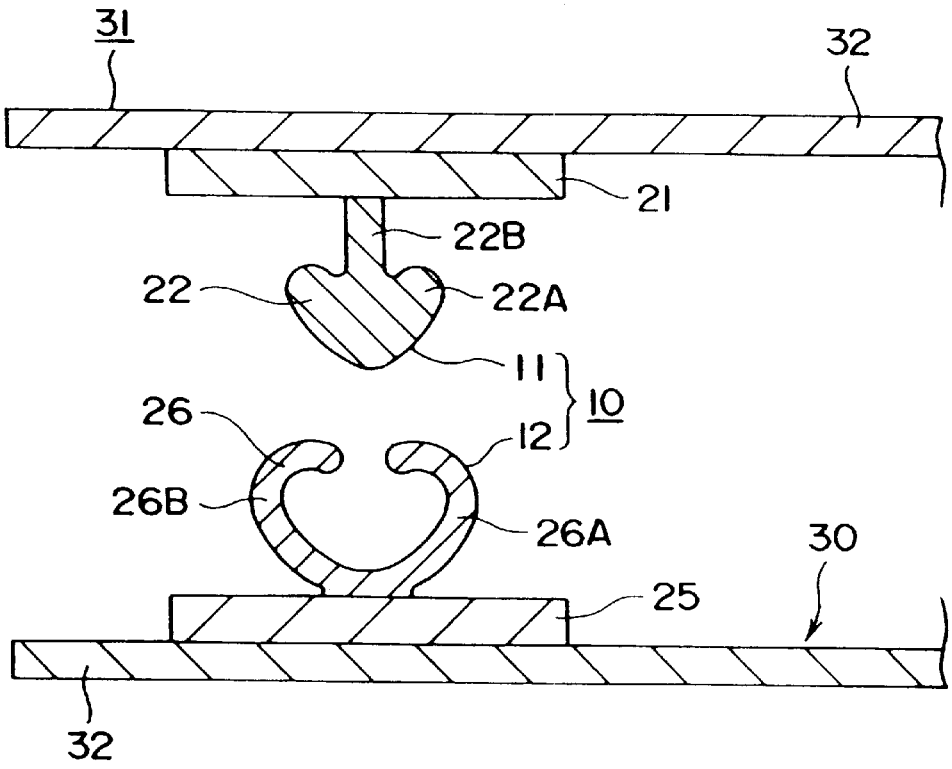
FIG. 1 is a sectional view of a snap zipper and a bag with a snap zipper according to the preferred embodiment of the present invention.
Figure 2:
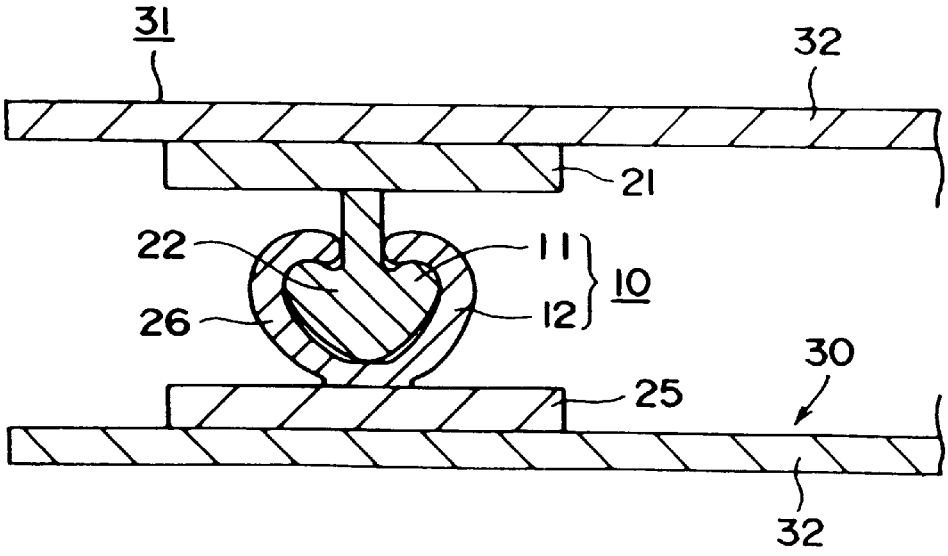
FIG. 2 is a sectional view of the snap zipper and the bag with the snap zipper of the preferred embodiment.

As shown in FIG. 1 and FIG. 2, a snap zipper 10 of the preferred embodiment is composed of a snap-zipper male member 11 as one of a pair of band-shaped members and a snap-zipper female member 12 as the other band-shaped member engaging with the snap-zipper male member 11.

The snap-zipper male member 11, in turn, has a band-shaped base 21 fused on a bag body 31 and a male engaging portion 22 having a snapping function. The male engaging portion 22 is composed of a cross-sectional heart-shaped head 22A, and a cross-sectional rod-shaped coupling section 22B extending between the head 22A and the band-shaped base 21.

The snap-zipper female member 12 has a band-shaped base 25 fused on the bag body 31, and a female engaging portion 26 having the snapping function. The female engaging portion 26 is composed of a first hook 26A and a second hook 26B, forming a cross-sectional arc, in which the hooks 26A and 26B are fused on the band-shaped base 25 to mutually face.

The male and female members 11 and 12 are formed from a mixture of polypropylene and an ethylene copolymer.

The ethylene copolymer is obtained by copolymerizing ethylene and an α-olefin having a carbon atom ratio of 3 to 20, in which the weight average molecular weight (Mw)/number average molecular weight (Mn) is less than 3, the density is in a range from 0.850 g/cm$^3$ to 0.935 g/cm$^3$, the melt index (MI) is in a range from 0.3 g/10 min. to 15 g/10 min., and the range of the number of branching dependent on the molecular weight is 0–5 branches/1,000 carbon.

The above-formed male member 11 of the embodiment is fabricated by fusing the band-shaped base 21 and the engaging portion 22 by co-extrusion. The female member 12 is fabricated by co-extrusion in the same way as the male member 11.

A bag with the snap zipper 30 of the embodiment is formed by fusing the band-shaped bases 21 and 25 of the male and female members 11 and 12 onto a film 32 forming the bag body 31.

Incidentally, in the embodiment, the snap-zipper male member 11 and the snap-zipper female member 12 are formed from the mixture of polypropylene and the ethylene copolymer. But, it is possible that only the band-shaped bases 21 and 25 are formed from the mixture of polypropylene and the ethylene copolymer, and the engaging portions 22 and 26 are formed from, for example, polypropylene, a low density polyethylene (LDPE), a linear low density polyethylene (L-LDPE) or the like.

Experiment 1

In the embodiment, the male member 11 and the female member 12 are each formed from a mixture of random polypropylene (70 wt.%), in which the MI is 7 g/10 min., and the ethylene copolymer (30 wt.%), in which the weight average molecular weight (Mw)/number average molecular weight (Mn) is 2.5, the density is 0.875 g/cm$^3$, the MI is 0.8 g/10 min., and the range of the number of branching dependent on molecular weight is 3.5 branches/1,000 carbon.

The film 32 forming the bag body 31 is a laminated film of a two-layer structure of a biaxially oriented polypropylene film (20 $\mu$m) layer and a non-oriented polypropylene film (30 $\mu$m) layer.

The bag 30 with the snap zipper 10 is produced at 80 units/min. to fuse the snap zipper 10 on the biaxially oriented polypropylene film layer as a sealant layer of the laminated layer.

Experiments 2 and 3

Each snap zipper 10 of Experiments 2 and 3 is obtained by changing the type of the ethylene copolymer in Experiment 1 or changing the mixing proportion of polypropylene and the ethylene copolymer.

In Experiment 2, polypropylene is defined as 90 wt.% and the ethylene copolymer of the same type as Experiment 1 is defined as 10 wt.%.

In Experiment 3, polypropylene is defined as 70 wt.%, the ethylene copolymer is defined as 30 wt.%, the weight average molecular weight (Mw)/number average molecular weight (Mn) is 2.5, the density is 0.903 g/m$^3$, MI is 6.0 g/10 min., and the range of the number of branching dependent on molecular weight is 3.5 branches/1,000 carbon.

The same laminated film as Experiment 1 is used for the film 32 forming the bag body 31 in Experiments 2 and 3.

Comparison 1

The snap zipper 10 is obtained to form the male member 11 and the female member 12 by using the random polypropylene as a single substance, used in Experiment 1.

Comparison 2

The snap zipper 10 is obtained to form the male member 11 and the female member 12 from a mixture of random polypropylene of 40 wt.% and the ethylene copolymer of 60 wt.%., which are the same type as Experiment 1.

The snap zippers 10 obtained in Experiments 1, 2 and 3 and Comparison 1 and 2 are evaluated as to low-temperature sealability, cold proofing and engagement performance of the snap zipper 10. The results are shown in Table 1.

The evaluation as the low-temperature sealability is carried out by measuring the zipper sealing temperature of the snap zipper 10 for the bag body 31 and the zipper crushing temperature of the snap zipper 10.

The zipper sealing temperature is examined by measuring a temperature required for obtaining a practical bonding strength when the band-shaped bases 21 and 25 are fused on the bag body 31.

In Table 1, when the zipper sealing temperature in Comparison 1 is a standard, X is a similar zipper sealing temperature to Comparison 1; Δ is lower than Comparison 1, in which the difference in temperature is less than 5° C.; ○ is a difference in temperature of more than 5° C. and less than 10° C.; and ◎ is a difference in temperature of more than 10° C.

The zipper crushing temperature is examined by measuring the temperature required for obtaining an effective crushing state when an area of the snap zipper 10, located at each side seal portion of the bag 30, is heatedly pressured (the crushing of zipper).

As to the evaluation of the zipper crushing temperature, when the zipper crushing temperature in Comparison 1 is a standard, X is a similar zipper crushing temperature to Comparison 1; Δ is lower than Comparison 1, in which the difference in temperature is less than 5° C.; ○ is a difference in temperature of more than 5° C. and less than 10° C.; and ◎ is a difference in temperature of more than 10° C.

The cold proofing of the snap zipper 10 is evaluated by; observing whether the top-ends of the head 22A of the male member 11 and the hooks 26A and 26B of the female member 12 are cracked or not, when the bag 30 is pulled twice from the opening side of the bag 30 in the opening direction, during the engaged state of the male and female members 11 and 12 of the snap zipper 10 of 50 mm width (in the opening direction of the band-shaped bases 21 and 25), by using a tensile tester provided in a thermostat controlled at zero degrees Celsius. ◎=non-crack. x=crack.

The engagement performance of the snap zipper 10 is evaluated by ten panelists who physically seal the snap zipper 10 by hand. Their evaluation results are shown in the following five ranks. The average point is shown in Table 1.

5 points: extremely smooth engagement 4 points: smooth engagement 3 points: normal engagement 2 points: awkward engagement 1 point : extremely awkward engagement

TABLE 1

| | Zipper sealing temperature | Zipper crushing temperature | Cold proofing | Engagement performance |
|---|---|---|---|---|
| Experiment 1 | ◎ | ◎ | ◎ | 4.6 |
| Experiment 2 | ◎ | ○ | ◎ | 4.8 |
| Experiment 3 | ○ | ○ | ◎ | 4.8 |
| Comparison 1 | — | — | x | 5.0 |
| Comparison 2 | ◎ | ◎ | ◎ | 1.6 |

From Table 1, it is understood that, as to the snap zipper 10 relating to Experiments 1 to 3, the snap-zipper male member 11 and the snap-zipper female member 12 is formed from the mixture of polypropylene and the ethylene copolymer, in which the ethylene copolymer has a weight average molecular weight (Mw)/number average molecular weight (Mn) of less than 3, density in the range from 0.850 g/cm$^3$ to 0.935 g/cm$^3$, MI in the range from 0.3 g/10 min. to 15 g/10 min., and the range of the number of branching dependent on molecular weight of 0–5 branches/1,000 carbon, so that the zipper sealing temperature and the zipper crushing temperature are lower than that of the snap zipper formed only from polypropylene in Comparison 1, thereby obtaining the effective low-temperature sealability. Therefore, the snap zippers 10 of Experiments 1 to 3 are allowed to be fused onto the film 32 and the crushing of zipper carried out at a low-temperature, thus avoiding heat deterioration of the film 32 including the biaxially oriented polypropylene film of the outer-most layer.

It is also understood that the snap zipper 10 of Experiments 1 to 3 includes the ethylene copolymer, so that further effective cold proofing is allowed to be obtained as compared with Comparison 1 in which the polypropylene element is used.

Further, it is shown that, in the male member 11 and the female member 12 of Comparison 2, the ethylene copolymer content of 60 wt.% is larger than that of Experiments 1 to 3 and exceeds 50 wt.%, so that the rigidity of the snap zipper 10 is decreased, thereby not allowing the smooth engagement performance to be obtained in view of the inferior sliding performance of the surface of the snap zipper.

What is claimed is:

1. A snap zipper having a snap-zipper male member and a snap-zipper female member, comprising:

a base for fusing formed in each of the snap-zipper male member and the snap-zipper female member; and a male engaging portion and a female engaging portion respectively formed in the snap-zipper male member and the snap-zipper female member to engage with each other, said base being formed from a mixture of polypropylene and an ethylene copolymer obtained by copolymerizing ethylene and an α-olefin having a carbon atom ratio of from 3 to 20, the ethylene copolymer having a weight average molecular weight/number average molecular weight of less than 3, density of from 0.850 g/cm$^3$ to 0.935 g/cm$^3$, melt index of from 0.3 g/10 min. to 15 g/10 min., and number of branching dependent on molecular weight of 0–5 branches/1,000 carbon.

2. The snap zipper according to claim 1, wherein the amount of ethylene copolymer in said mixture is from 1 wt.% to 50 wt.%.

3. The snap zipper according to claim 2, wherein the melt index of the polypropylene is from 1 g/10 min. to 20 g/10 min.

4. The snap zipper according to claim 1, wherein the melt index of the polypropylene is from 1 g/10 min. to 20 g/10 min.

5. The snap zipper according to any one of claims 1, 2, 3 and 4, wherein said bases of the snap-zipper male member and the snap-zipper female member are each formed to have a band-shape;

said female engaging portion of the snap-zipper female member has a pair of hooks formed along the elongated direction of said base; and said male engaging portion of the snap-zipper male member has a heart-shaped head formed along the elongated direction of said base to be inserted into and removed from between a pair of said hooks, and a coupling section extending between the head and said base.

6. A bag with a snap zipper, in which the snap zipper having a snap-zipper male member and a snap-zipper female member is fused on a bag body, comprising:

a base for fusing formed in each of the snap-zipper male member and the snap-zipper female member; and a male engaging portion and a female engaging portion respectively formed in the snap-zipper male member and the snap-zipper female member to engage with each other, said base being formed from a mixture of polypropylene and an ethylene copolymer obtained by copolymerizing ethylene and an α-olefin having a carbon atom ratio of from 3 to 20, the ethylene copolymer having a weight average molecular weight/number average molecular weight of less than 3, density of from 0.850 g/cm$^3$ to 0.935 g/cm$^3$, melt index of from 0.3 g/10 min. to 15 g/10 min., and number of branching dependent on molecular weight of 0–5 branches/1,000 carbon, and the snap-zipper male member and the snap-zipper female member being fused through said bases to the bag body.

7. The bag with the snap zipper according to claim 6, wherein the amount of the ethylene copolymer in said mixture is from 1 wt.% to 50 wt.%.

8. The bag with the snap zipper according to claim 7, wherein the melt index of the polypropylene is from 1 g/10 min. to 20 g/10 min.

9. The bag with the snap zipper according to claim 6, wherein the melt index of the polypropylene is from 1 g/10 min. to 20 g/10 min.

10. The bag with the snap zipper according to claim 9, wherein the bag body has a sealant layer formed from polypropylene, said snap zipper being fused onto the sealant layer.

11. The bag with the snap zipper according to any one of claims 6, 7, 8, 9 and 10, said bases of the snap-zipper male member and the snap-zipper female member are each formed in a band shape;

said female engaging portion of the snap-zipper female member has a pair of hooks formed along the elongated direction of said base; and said male engaging portion of the snap-zipper male member has a heart-shaped head formed along the elongated direction of said base to be inserted into and removed from between a pair of said hooks, and a coupling section extending between the head and said base.

* * * * *